US006419505B1

(12) United States Patent
Waible

(10) Patent No.: US 6,419,505 B1
(45) Date of Patent: Jul. 16, 2002

(54) INSERT FOR A FEMALE PLUG COUPLING FOR AN ELECTRIC CONNECTOR PLUG

(75) Inventor: Thomas Waible, Waldbronn (DE)

(73) Assignee: Taller GmbH, Waldbronn (DE)

( * ) Notice: Subject to any disclaimer, the term of this patent is extended or adjusted under 35 U.S.C. 154(b) by 0 days.

(21) Appl. No.: 09/806,634

(22) PCT Filed: Sep. 17, 1999

(86) PCT No.: PCT/EP99/06895

§ 371 (c)(1),
(2), (4) Date: Apr. 19, 2001

(87) PCT Pub. No.: WO00/21162

PCT Pub. Date: Apr. 13, 2000

(30) Foreign Application Priority Data

Oct. 6, 1998 (DE) ..... 198 47 067

(51) Int. Cl.[7] ..... H01R 4/66; H01R 13/648; H01R 13/58

(52) U.S. Cl. ..... 439/106; 439/606

(58) Field of Search ..... 439/106, 606, 439/695, 696, 697

(56) References Cited

U.S. PATENT DOCUMENTS

| | | | | | |
|---|---|---|---|---|---|
| 4,958,048 | A | * | 9/1990 | Bell | 174/53 |
| 5,603,638 | A | | 2/1997 | Brown et al. | 439/606 |
| 5,647,751 | A | | 7/1997 | Shulman et al. | 439/106 |
| 5,662,484 | A | * | 9/1997 | Blanche | 439/106 |
| 6,168,443 | B1 | * | 2/2001 | Mullen et al. | 439/106 |
| 6,190,212 | B1 | * | 2/2001 | Brown et al. | 49/106 |

FOREIGN PATENT DOCUMENTS

| | | |
|---|---|---|
| DE | 30 37 450 | 4/1982 |
| FR | 1 155 125 | 4/1958 |

* cited by examiner

*Primary Examiner*—Brian Sircus
*Assistant Examiner*—Chandrika Prasad
(74) *Attorney, Agent, or Firm*—Baker & Daniels

(57) ABSTRACT

A female plug coupling having three plug openings to accommodate the current conductors and the ground conductor of a male plug coupling. The female plug coupling includes an insert constructed whereby all the crimp connections lie in a single plane to facilitate crimping on the conductor ends to the female plug coupling.

15 Claims, 2 Drawing Sheets

INSERT FOR A FEMALE PLUG COUPLING FOR AN ELECTRIC CONNECTOR PLUG

CROSS-REFERENCE TO RELATED APPLICATIONS

The present application is a National Stage Application under 35 U.S.C. §371, of PCT International Patent Application Number PCT/EP99/06895, (published as International Publication Number WO 00/21162), filed Sep. 17, 1999, that designated the United States, which stems from German Application No. 198 47 067.3, filed Oct. 6, 1998.

BACKGROUND OF THE INVENTION

1. Field of the Invention

The present invention relates to a female plug coupling having three plug openings. More particularly, the present invention relates to an improved insert for a female plug coupling having three plug openings.

2. Description of the Related Art

Such plug couplings are in use in the USA and Japanese markets. For example, a plug coupling is shown in U.S. Pat. No. 5,647,751. According to the state of the art, female plug couplings consist of a two-part plastic material body in which the crimp connection pins for the conductor ends are inserted. The conductor ends are crimped on, i.e., fixed on, to the crimp connection pins and, the insert is extrusion-coated and thus forms the core of a grip body. The face side of this grip body has three plug openings arranged in a triangle to one another in a complementary manner to the contact pins of the connector plug. One of the connector plug contact pins is round, and the other two (current conducting) contact pins are rectangular.

In the manufacturing of the inserts for the plug coupling, problems have arisen in connection with the crimping-on of the conductor ends to the effect that it has proved difficult to perform the working step CRIMPING with a simple tool in a single operation. By reason of the arranging and assigning of the crimp connection ends in different topological planes, there is involved on the one hand a complicated tool and, on the other hand, different and in part diametrical force directions.

SUMMARY OF THE INVENTION

The present invention provides a plug coupling in which all the crimp connections lie in one and the same plane and which, therefore, can be executed in one operation with a simple one-piece tool.

In this regard, the special form of execution chosen for the crimp connection of the ground conductor has additionally proved to be especially advantageous, as the plugging force for the corresponding contact pin of the connector plug is relatively slight because of the shortness of the contact length of the plugging path. Both for the current conductor contact pins, and also for the protective conductor contact pin, there have been provided on the corresponding parts of the plug, coupling lugs or lashes which provide introduction aids.

BRIEF DESCRIPTION OF THE DRAWINGS

The invention is explained in the following with the aid of the drawings, wherein.

DETAILED DESCRIPTION OF THE INVENTION

Figures 1, 2, 3, 4:
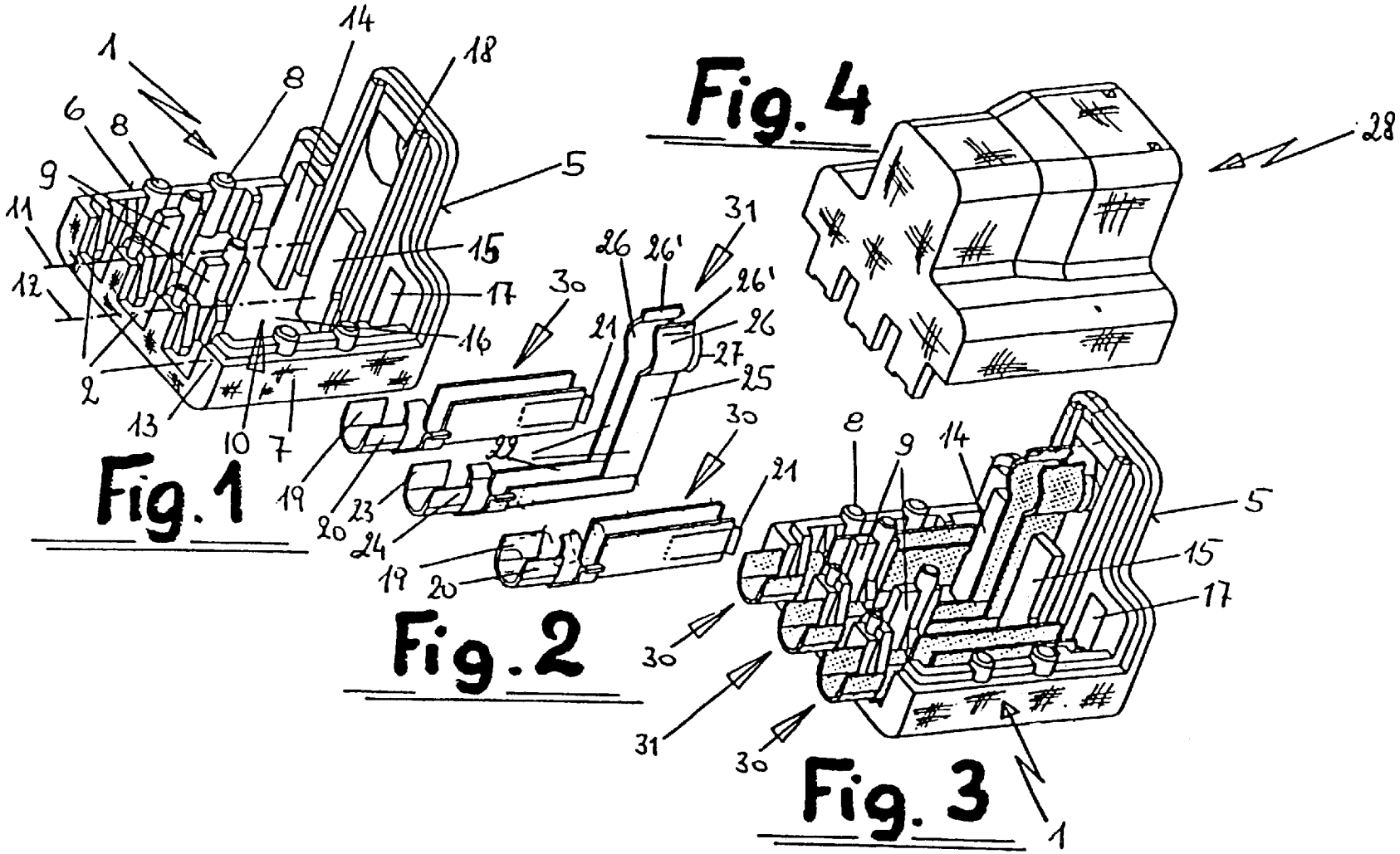
FIG. 1 is a representation of an exemplary base body.
FIG. 2 illustrates the crimp connection pins for the current conductors and the ground conductor to be installed in the base body illustrated in FIG. 1 next to one another.
FIG. 3 illustrates the base body according to FIG. 1, with the crimp connection pins according to FIG. 2 installed therein.
FIG. 4 provides an outside view of a cover cap of the insert of the present invention.

In FIG. 1 there is represented a base body 1 made of hard elastic plastic material. Base body 1 includes three incisions 2 for the installing of the crimp connection pins 30, 31 (see, e.g., FIGS. 2 and 3). Opposite incisions 2, base body 1 includes a face wall 5, which abuts raised edges 6, 7 of the base body 1. The base body 1 has a plurality of molded-on pins 8 and columns 9 and further includes separated insertions channels 11, 12, 13 formed between the front edge of base body 1 (i.e., the edge having incisions 2 formed therein), and face wall 5. Opposite the face wall 5 there are molded two higher columns 14, 15, the importance of which will be described later.

In the face wall 5, in the lower zone adjacent to the base bottom 16, there are provided two rectangular passage openings 17, into which the current conductor contact pins of the connection plug are introduced. In the upper zone there is provided a passage opening 18 for the round contact pin (ground pin) of the connector plug.

FIG. 2 shows, next to one another in quasi-assembled position, a crimp connection pin 30 for a current conductor, a crimp connection pin 31 for the ground conductor, and a (second) crimp connection pin 30 for the second current conductor. Each crimp connection pin 30 consists of a metal strip bent in U-form, in which at one end there are formed a pair of crimping claws 19, 20, and at the other end a pair of laterally spaced lugs 21. Lugs 21 receive the rectangular contact pins of the connecting plug and serve as an introduction aid therefor. The distance between the U-shaped shanks of the metal strip is chosen in such manner that the rectangular current conductor contact pins of the connector plug are engaged snugly and with force-closure, i.e. have contact.

The crimp connection pin 31 for the ground conductor is designed according to the preferred example represented in FIG. 2 as an L-shaped metal part, having a leg thereof formed from a U-shaped metal strip so that, as with the crimp connection pins 30, there results a U-shaped metal strip 22 with a pair of crimping claws 23, 24. The second leg, or base of the L-shaped crimp connection 31 is formed by two webs 25 extending from the U-shaped leg. The two webs 25 spring against one another and include receiving claws 26 for the round contact pin of the connector plug. The spacing of receiving claws 26 to one another is chosen in correspondence to the diameter of the round contact pin, i.e., the ground conductor. On one side of the receiving claws 26, facing away from the crimping claws 23, 24, there is formed in each case an obliquely outwardly directed lash 27 which facilitates introduction of the protective conductor contact pin. Because of the only slight contact length of the contact pin inside the receiving claws 26 of the parallel webs 25, only a relatively slight plugging force is required.

In order to prevent the possibility that, for example, a connection plug may be inserted with too thick a protective conductor contact pin, the receiving claws 26 include cross webs 26'. Cross webs 26' cooperate with complementary stops 29 (in the interior of the cover cap 28) to prevent overstretching of receiving claws 26.

The "cross section form," i.e., the form of the crimp connection pin 31 for the protective conductor contact pin also may be other than L-shaped; there is also thinkable a Z-form or the like, for example.

In FIG. 3, the crimp connection pins 30 and 31 are positioned in base body 1. The two laterally lying crimp connection pins 30 lie in the insertion channels 11, and 13 formed from the molded-on pins 8 and columns 9, 14, 15 and crimping connection pin 31 lies in the middle insertion channel 12. The crimping connection pin 31 is supported by its two resilient webs 25 between the higher columns 14, 15 lying opposite the face wall. The receiving claws 26, molded on the upright webs 25 of the L-shaped crimp connection pin 31, lie opposite the passage opening 18 in the face wall 5.

Figure 5:
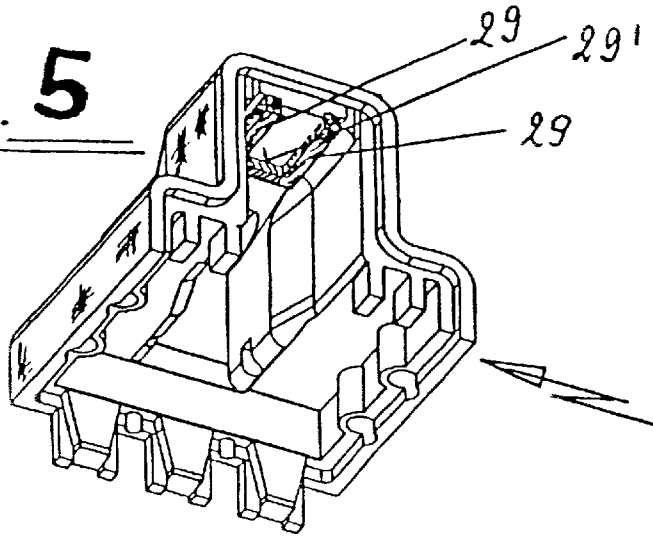
FIG. 5 provides an inside view of the cover cap according to FIG. 4.

FIG. 4 and FIG. 5 show a cover cap 28 complementary to the base body 1, which cap is so constructed that it closes over the incisions 2 for the crimp connection pins 30, 31, stands upright on the raised edges 6, 7 and abuts the periphery of face wall 5. In this way, the interior space of insert 50 is protected against the plastic injected into an injection mold to form a complete receptacle. As mentioned with the aid of FIG. 2, the cover cap 28 has on its inside two stops 29 complementary to the cross webs 26' of the receiving claws 26 of the crimp connection pin 31, which stops protect the receiving claws 26 against an overstretching. Stops 29 are connected, via a cross web 29', to the ends of receiving claws 26 away from the face side of the cover cap 28, wherewith a support against tilting is ensured for the receiving claws 26, in the inserting of the connector plug.

Figure 6:
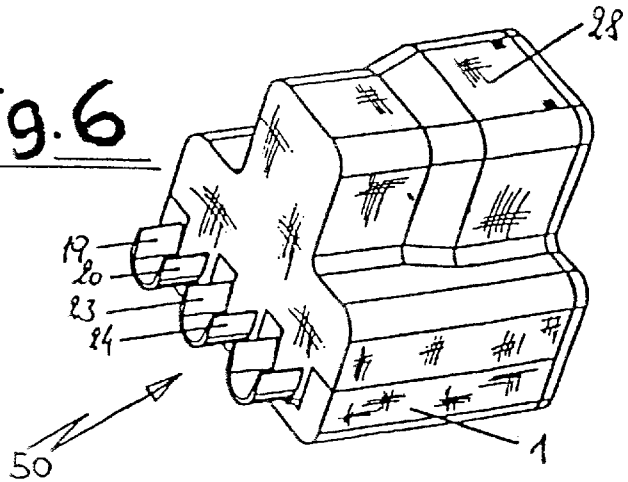
FIG. 6 illustrates a complete insert for a plug coupling composed of the base body according to FIG. 1, with the crimp connection pins positioned therein as illustrated in FIG. 3, and of the cover cap according to FIG. 4 and FIG. 5.

According to the representation in FIG. 6, the cover cap 28 is emplaced or clipped on the base body 1, so that now there is present a closed body/insert 50. To the outside there stand out only the spired crimp claws 19, 20, and 23, 24, of the crimping connection pins 30, 31, respectively. The representation in FIG. 6 shows the assemblage state in which the strands of a supply line are laid in and the crimping tool is applied.

Figure 7:
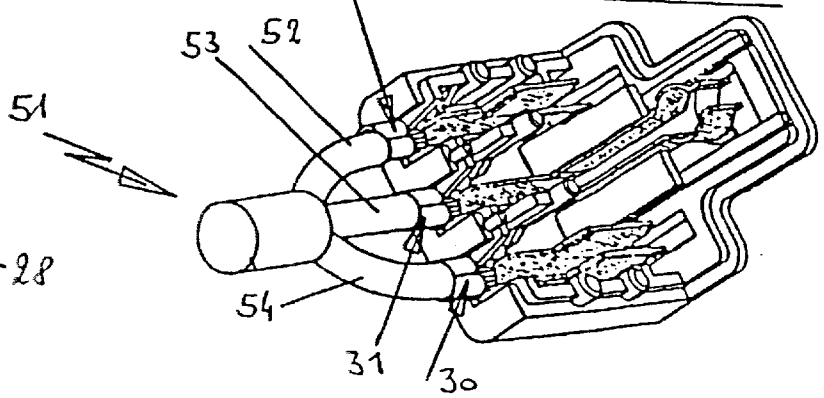
FIG. 7 illustrates the installation according to FIG. 6 with the cover cap removed to illustrate a crimped-on supply line.

FIG. 7 shows the body/insert 50 with a crimped-on supply line 51 in which, for reasons of perspicuity, the cover cap 28 is not shown in the drawing. The three strands 52, 53, 54 of this supply line are crimped according to their respective allocation with the crimp connection pins 30, 31. According to the present invention, strands 52, 53, 54 of supply line 51 are crimped to connection pins 30, 31 with a one-piece crimping tool which "rolls up," i.e., crimps with form and force closure, the strand connections 52, 53, 54 of the supply line 51, that lie in one and the same plane with the crimp connection pins 30, 31 lying in the same plane, i.e., the working plane.

Figure 8:
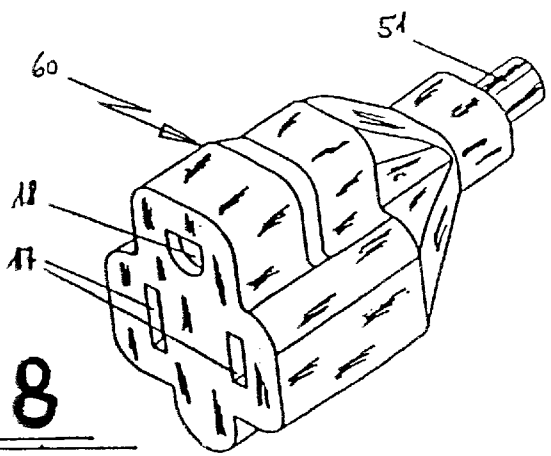
FIG. 8 illustrates a finished plug coupling including the insert of the present invention.

With the aid of FIG. 8 there is to be shown the end product "PLUG COUPLING." The insert/body 50 joined with the supply line 51 is injection-molded from soft-elastic plastic material, so that there results a finished plug coupling 60. This has on its quasi face side formed by the face wall 5, the three through openings 17, 18 (described above in connection with FIG. 1) into which the complementary contact pins of an apparatus plug can be inserted, wherewith then the connection with the current supply mains can be established.

What is claimed is:

1. An insert for a female plug coupling having three plug openings accommodating two current conductors and a ground conductor of a male plug coupling, the insert comprising:

a receiving body;

a plurality of crimp connection pins for the two current conductors and the ground conductor, said crimp connection pins positioned in said receiving body;

a cover cap emplaced on the receiving body after the crimp connection pins are positioned in the receiving body, wherein the current conductors and the ground conductor are arranged relatively to one another in a triangle, characterized in that:

the receiving body comprises a base body having an upright-standing face wall and a plurality of insertion channels for receiving the crimp connection pins for the current conductors and the ground conductor, crimp connections of the crimp connection pins for the current conductors and the ground conductor being substantially coplanar when said crimp connection pins are received in said insertion channels, and wherein the face wall has a plurality of passage openings arranged in correspondence with the relative arrangement of the current conductors and the ground conductor, in such manner that the passage openings for the current conductors are adjacent to a base of the base body and the passage opening for the ground conductor has a pair of resilient receiving claws for engaging the ground conductor of the male plug coupling.

2. Plug coupling according to claim 1, characterized in that the crimp connection pin for the ground conductor is constructed in L-shape, wherein the L-shaped crimp connection for the ground conductor includes a first leg parallel to the crimp connection pins for the current conductors, and wherein the L-shaped crimp connection for the ground conductor includes a second leg in the form of two parallel webs protruding from the first leg and running parallel to the face wall, said second leg including said pair of resilient receiving claws for engaging the ground conductor of the male plug coupling.

3. Plug coupling according to claim 1, characterized in that each crimp connection pin for the current conductors comprises a U-shape bent metal strip, in which the spacing of the U-shaped shank corresponding to the thickness of the current conductors of the male plug coupling is chosen in such manner that the current conductors lie against the U-shaped shanks.

4. Plug coupling according to claim 3, characterized in that each crimp connection pin for the current conductors includes a laterally spaced protruding lug adjacent the passage openings for the current conductors.

5. Plug coupling according to claim 2, characterized in that the first leg of the crimp connection pin for the ground conductor comprises a U-shape bent metal strip, and wherein the parallel webs and resilient receiving claws of the second leg of the crimp connection pin for the ground conductor have a spacing chosen in correspondence to the size of the ground conductor of the male plug coupling in such manner that the ground conductor lies against the receiving claws.

6. Plug according to claim 5, characterized in that the receiving claws have lash plates obliquely protruding from the passage opening for the ground conductor.

7. Plug coupling according to claim 1, characterized in that the receiving claws each include a cross web, and wherein the cover cap includes a stop corresponding to each cross web, whereby each cross web cooperates with the corresponding stop to limit movement of the parallel webs of the second leg of the crimp connection pin for the ground conductor so that in the inserting of the connector plug the receiving claws are protected against overstretching.

8. Plug coupling according to claim 7, characterized in that the stops are connected by a cross stop abutting the stops, said cross stop positioned a distance from the face wall.

9. Plug coupling according to claim 2, characterized in that each crimp connection pin for the current conductors comprises a U-shape bent metal strip, in which the spacing of the U-shaped shank corresponding to the thickness of the current conductors of the male plug coupling is chosen in such manner that the current conductors lie against the U-shaped shanks.

10. Plug coupling according to claim 9, characterized in that each crimp connection pin for the current conductors comprises a U-shape bent metal strip, in which the spacing of the U-shaped shank corresponding to the thickness of the current conductors of the male plug coupling is chosen in such manner that the current conductors lie against the U-shaped shanks.

11. Plug coupling according to claim 2, characterized in that the receiving claws each include a cross web, and wherein the cover cap includes a stop corresponding to each cross web, whereby each cross web cooperates with the corresponding stop to limit movement of the parallel webs of the second leg of the crimp connection pin for the ground conductor so that in the inserting of the connector plug the receiving claws are protected against overstretching.

12. Plug coupling according to claim 3, characterized in that the receiving claws each include a cross web, and wherein the cover cap includes a stop corresponding to each cross web, whereby each cross web cooperates with the corresponding stop to limit movement of the parallel webs of the second leg of the crimp connection pin for the ground conductor so that in the inserting of the connector plug the receiving claws are protected against overstretching.

13. Plug coupling according to claim 4, characterized in that the receiving claws each include a cross web, and wherein the cover cap includes a stop corresponding to each cross web, whereby each cross web cooperates with the corresponding stop to limit movement of the parallel webs of the second leg of the crimp connection pin for the ground conductor so that in the inserting of the connector plug the receiving claws are protected against overstretching.

14. Plug coupling according to claim 5, characterized in that the receiving claws each include a cross web, and wherein the cover cap includes a stop corresponding to each cross web, whereby each cross web cooperates with the corresponding stop to limit movement of the parallel webs of the second leg of the crimp connection pin for the ground conductor so that in the inserting of the connector plug the receiving claws are protected against overstretching.

15. Plug coupling according to claim 6, characterized in that the receiving claws each include a cross web, and wherein the cover cap includes a stop corresponding to each cross web, whereby each cross web cooperates with the corresponding stop to limit movement of the parallel webs of the second leg of the crimp connection pin for the ground conductor so that in the inserting of the connector plug the receiving claws are protected against overstretching.

* * * * *

UNITED STATES PATENT AND TRADEMARK OFFICE

CERTIFICATE OF CORRECTION

PATENT NO. : 6,419,505 B1
DATED : July 16, 2002
INVENTOR(S) : Thomas Waible

It is certified that error appears in the above-identified patent and that said Letters Patent is hereby corrected as shown below:

Title page,
Item [54], delete "INSERT FOR A FEMALE PLUG COUPLING FOR AN ELECTRIC CONNECTOR PLUG" and substitute therefor -- INSERT FOR A THREE-POLE FEMALE ELECTRIC CONNECTOR FOR AN ELECTRIC CONNECTOR PLUG --

Signed and Sealed this

Tenth Day of December, 2002

JAMES E. ROGAN
*Director of the United States Patent and Trademark Office*